US005830119A

United States Patent [19]

Chen

[11] Patent Number: 5,830,119

[45] Date of Patent: Nov. 3, 1998

[54] BAG WITH CLOSURE TIE AND METHOD OF MAKING

[76] Inventor: Yu-Lin Chen, 10 Sarah's Cove, Sugarland, Tex. 77479

[21] Appl. No.: 637,402

[22] Filed: Apr. 25, 1996

[51] Int. Cl.[6] ..... B65D 30/06; B65D 33/12

[52] U.S. Cl. ..... 493/210; 493/213; 493/214; 493/227; 493/235; 493/239; 493/383; 493/928; 493/962

[58] Field of Search ..... 493/210, 212, 493/213, 214, 227, 235, 231, 233, 239, 243, 245, 254, 255, 288, 299, 343, 344, 350, 356, 363, 375, 378, 379, 383, 384, 385, 390, 392, 393, 394, 405, 918, 927, 928, 935, 962, 374

[56] References Cited

U.S. PATENT DOCUMENTS

| | | | |
|---|---|---|---|
| 1,185,651 | 6/1916 | Fross | 383/75 |
| 2,546,623 | 3/1951 | Abler | 383/75 |
| 2,563,616 | 8/1951 | Perino | 383/76 |
| 2,615,488 | 10/1952 | Brady | 383/76 |
| 3,046,847 | 7/1962 | Voege | 493/212 |
| 3,797,043 | 3/1974 | Brument | 373/75 |
| 4,493,109 | 1/1985 | Nattrass | 493/226 |
| 4,547,237 | 10/1985 | Hendrickson | 383/75 |
| 4,750,292 | 6/1988 | Alstig | 383/72 |
| 4,880,316 | 11/1989 | Belmont | 383/75 |
| 4,959,045 | 9/1990 | Hartley | 493/254 |
| 5,050,999 | 9/1991 | Van Loon, III | 493/928 |
| 5,092,681 | 3/1992 | Ashley, III | 383/76 |
| 5,184,897 | 2/1993 | Gozdenovich et al. | 383/75 |
| 5,232,429 | 8/1993 | Cizek | 493/299 |
| 5,240,105 | 8/1993 | Tsai | 383/72 |
| 5,378,220 | 1/1995 | Bunn | 493/254 |
| 5,415,614 | 5/1995 | Nattrass | 493/226 |

FOREIGN PATENT DOCUMENTS

| | | | |
|---|---|---|---|
| 2430895 | 3/1980 | France | 493/928 |
| 2 224 264 | 5/1990 | United Kingdom | 383/75 |

*Primary Examiner*—John Sipos
*Assistant Examiner*—Christopher W. Day
*Attorney, Agent, or Firm*—Thomas R. Lampe

[57] ABSTRACT

A double-ended bag is formed from a tubular woven sheet having at least one tie member extending along the length of the tubular sheet. The tubular sheet is cut to create bag panels and tie member segments in registration. The bag panels are sewn together with the bag panels in registry and the tie member segments in registry.

8 Claims, 6 Drawing Sheets

BAG WITH CLOSURE TIE AND METHOD OF MAKING

TECHNICAL FIELD

This invention relates to a bag construction and method of manufacturing the bag. More particularly, the bag incorporates a tie for selective closure of the bag. The invention is applicable, for example, for use in the transport and delivery of postal materials.

BACKGROUND ART

It is common practice to use bulk bags to transport mail. In the case of mail transported from one country to another it is customary to employ non-returnable bags for such purpose; a particularly widespread approach being to utilize bags formed from flat woven polypropylene or other plastic sheeting material. Considerable manual labor is expended in the fabrication process related to the prior art bag constructions. Furthermore, material costs relating to conventional prior art bags are relatively high, particularly when one considers that international postal bags of this nature are essentially utilized on a one-way basis and not returned.

DISCLOSURE OP INVENTION

The present invention encompasses a method which inexpensively, efficiently, and effectively provides for the manufacture of a double-ended bag of specified character including an elongated flexible tie for selectively closing the opening of the bag. The bag itself is also encompassed by the present invention.

The bag is a double-ended bag having first and second bag panels defining a bag interior and a bag opening at one end communicating with the bag interior. The bag additionally includes an elongated flexible tie located adjacent to the bag opening for selectively closing the bag opening.

The method of manufacturing the bag includes the step of tubular weaving a sheet of flexible material to form an elongated tube comprised of woven warp and weft strands, the tube having a primary axis.

During said tubular weaving step, first and second tie segments are woven into said strands, said first and second tie segments extending along said tube in the direction of said primary axis.

An elongated opening is formed in said tube extending along said tube in the direction of said primary axis and adjacent to said first and second tie segments.

The tube material is severed along spaced lines of cut transverse to said primary axis to form a tube material segments, each tube material segment comprising two bag panels, with each bag panel having a panel top end, a panel bottom end and two spaced panel side edges extending between the panel top end and the panel bottom end, and each panel having a tie segment connected thereto and woven therein.

The two bag panels are brought together into substantial registration with the panels extending from a fold.

Substantially simultaneously with the step of bringing the two bag panels together, the tie segments connected thereto are brought into substantial registry.

The bag panels are sewn together, with the panel top ends being unsecured and forming said bag opening and the tie segments disposed adjacent to said opening and extending along said bag panels.

In a disclosed preferred embodiment, during the tubular weaving step, first and second tie members are woven into the strands. The first and second tie members are spaced from one another and extend along the length of the tube in the direction of the primary axis.

An elongated opening is formed in the tube extending along the length of the tube in the direction of the primary axis. The elongated opening is located between the first and second tie members.

The tube and the first and second tie members are severed along spaced lines of cut transverse to the primary axis to divide the tube into separate tube sections and to divide the first and second tie members into double-ended first and second tie segments.

Each tube segment comprises two bag panels, with each bag panel having a panel top end, a panel bottom end and two spaced panel side edges extending between the panel top end and the panel bottom end. Each panel has a tie segment connected thereto and woven therein.

The two bag panels are brought together into substantial registration with the panel bottom ends forming a fold.

Substantially simultaneously with the step of bringing the two bag panels together, the tie segments connected thereto are brought into substantial registration.

The bag panels are sewn together along the panel side edges thereof, with the panel top ends being unsecured and forming the bag opening.

The method also includes the step of securing together the first and second tie segments to form a unitary tie extending along the sewn bag panels adjacent to the bag opening.

The double-ended bag of the invention includes first and second bag panels, each of the bag panels being formed of woven flexible material with warp and weft strands and having a panel top end, a panel bottom end and two spaced panel side edges extending between the panel top end and the panel bottom end.

The bag panels are substantially in registry and define a bag opening. The bag panels are sewn together along the panel side edges thereof, integrally woven together at a fold formed at the bottom panel ends, and the panel top ends define a bag opening communicating with the bag interior.

An elongated flexible tie is located adjacent to the bag opening for selectively closing the bag opening. The tie includes a first elongated flexible tie segment having two tie segment ends. The first elongated flexible tie segment is woven into the strands of the first bag panel and located adjacent to and extending substantially parallel to the panel top end of the first bag panel.

The tie further includes a second elongated flexible tie segment having two tie segment ends, the second elongated flexible tie segment woven into the strands of the second bag panel and located adjacent to and extending substantially parallel to the panel top end of the second bag panel.

One end each of the first and second elongated flexible tie segments are sewn together and one end each of the first and second flexible tie segments extends away from the back panels.

Other features, advantages, and objects of the present invention will become apparent with reference to the following description and accompanying drawings.

MODES FOR CARRYING OUT THE INVENTION

Figure 6:
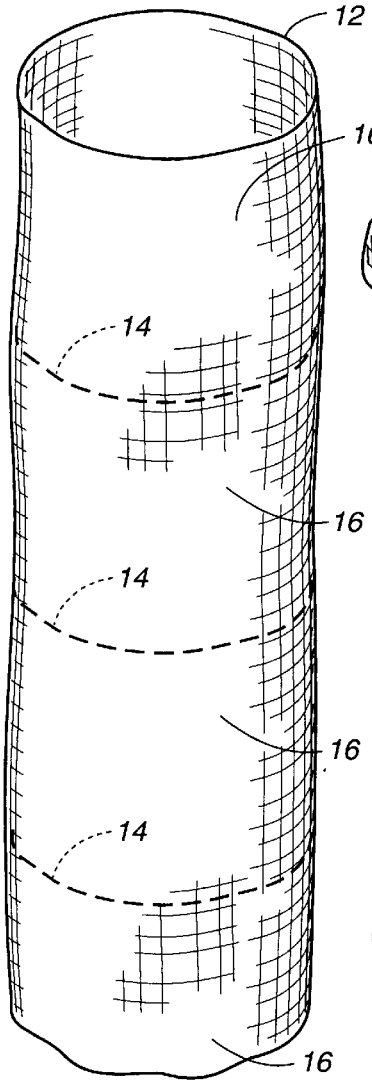
FIG. 6 (PRIOR ART)
FIG. 6 illustrates a prior art elongated tube comprised of woven warp an weft strands which is subsequently converted to form a prior art bag.
Figure 7:
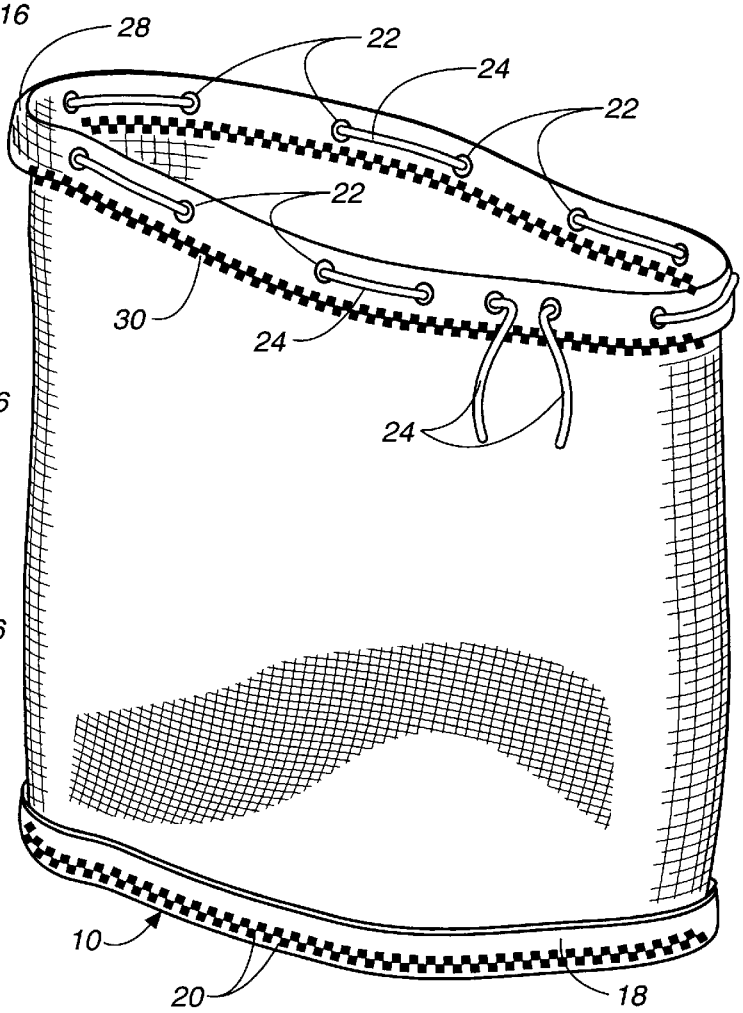
FIG. 7 (PRIOR ART)
FIG. 7 is a perspective view of a typical prior art bag fabricated from the elongated tube of FIG. 6.

FIG. 7 illustrates a typical prior art bag of the type conventionally employed to transport international mail on a one-way basis. The bag 10 has been converted from an elongated tube 12 shown in FIG. 6. Conventionally, the prior art bag and tube are formed from flat, narrow woven plastic warp and weft strands in a conventional tubular weaving machine (not shown). An example of such machine is the YT900 tubular weaving machine made available by Yao-Ta Manufacturing Company of Taiwan.

Considerable labor is involved when converting the tube 12 into bags such as bag 10. An initial step in the process is to sever the tube 12 along lines of cut 14, forming individual tube segments 16.

As can be seen with reference to FIG. 7, the body of bag 10 is essentially comprised of one of the tube segments 16. The bottom of the tube segment is folded over as at 18 and stitched along one or more lines of stitching 20 to close the bottom of the tube segment and thus provide the closed bottom of the bag.

At the other end thereof, i.e. the top end, the tube segment 16 has holes 22 punched therein at spaced intervals and a tie 24 is inserted through the holes, with the two distal ends 26 being brought into close proximity. The top end of the tube segment 16 is then folded over to form an outer lip 28 which is subsequently stitched by stitching 30 to the adjacent portion of the tube segment. The tie 24 is of one-piece or integral construction and extends virtually completely about the circumference of the bag. The distal ends 26 can be pulled to constrict the top of the bag 10 and close the top opening of the bag.

Figure 3:
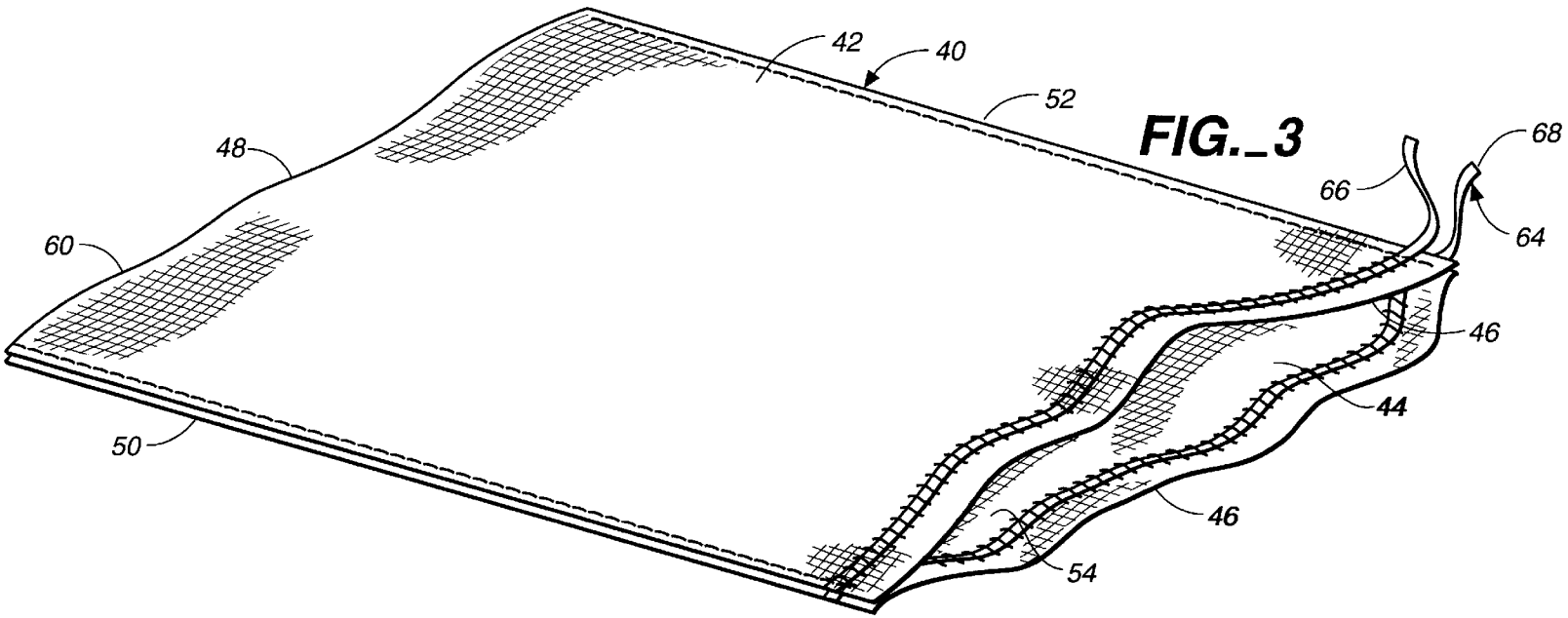
FIG. 3 is an enlarged perspective view of a double-ended bag constructed in accordance with the teachings of the present invention.
Figure 5:
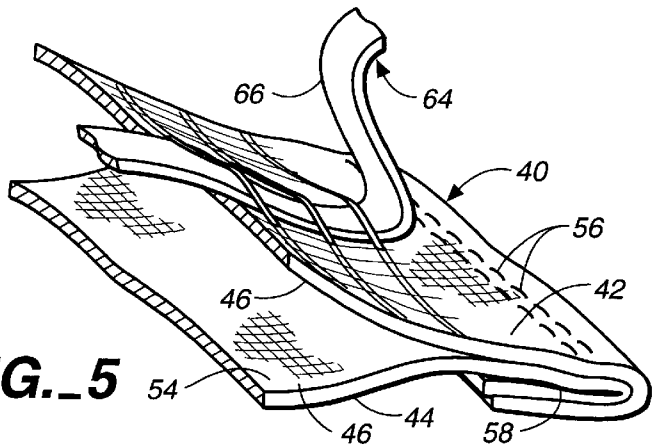
FIG. 5 is an enlarged, detail view illustrating the joinder of two other panel side edges and an end of a tie operatively associated therewith.
Figure 4:
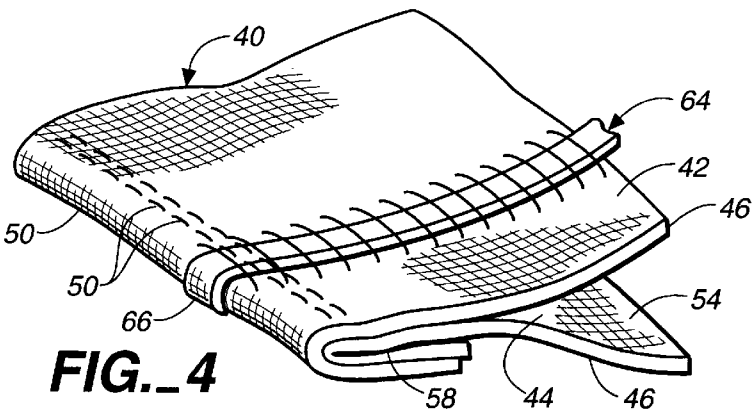
FIG. 4 is a greatly enlarged, detail view illustrating sewn bag panel side edges and an end of a tie.

A bag constructed in accordance with the teachings of the present invention is shown in FIGS. 3, 4 and 5 and is designated by reference numeral 40. Bag 40 includes a first bag panel 42 and a second bag panel 44, each of the bag panels being formed of woven flexible material with warp and weft strands. A material which has been found to be particularly suitable in the practice of the present invention is polypropylene in the form of narrow, thin strips.

Each bag panel has a panel top end 46, a panel bottom end 48 and two spaced panel side edges 50, 52 extending between the panel top end and the panel bottom end.

Bag panels 42, 44 are in registry and define a bag interior 54. The bag panels are sewn together by stitching 56 along the panel side edges thereof. It is to be noted that the side edges of the bag panels are doubled over or folded to form a bight 58 at each edge, the stitching 56 passing through the bight at each edge to create a strong, secure and stable interconnection between the bag panels at the side edges.

The bag panels 42, 44 are formed from a integral sheet of woven flexible material with the panels integrally woven together at a fold 60 formed at and by the panel bottom ends. The panel top ends 46 define a bag opening communicating with the bag interior. An elongated flexible tie 64 is located adjacent to the bag opening for selectively closing the bag opening.

Tie 64 includes a first elongated flexible tie segment 66 having two tie segment ends. Tie segment 66 is loosely woven into the strands of bag panel 42, the tie segment being free to move relative to the bag panel except as described below. Tie segment 66 is located adjacent to and extends substantially parallel to the panel top end of bag panel 42.

Tie 64 further includes a second elongated flexible tie segment 68 having two tie segment ends. Tie segment 68 is loosely woven into the strands of the second bag panel 44 and is free to move relative to the second bag panel except as will be described below. Tie segment 68 is located adjacent to and extends substantially parallel to the panel top end of bag panel 44.

The tie segments 66, 68 come together at panel side edges 50 of the bag panels and are secured thereto by the stitching 56 at that side edge. FIG. 4 shows tie segment 66 looping and passing around to the other side of the edge 50. The corresponding end of tie segment 68 is encompassed by the bight 58 at the edge and is thus sewn to both the bag panels and the tie segment 66 at such location.

The other ends of the tie segments, the distal ends, extend beyond the panel side edges 52 of the bag panels and these distal ends are for grasping by an individual to cinch closed the open end of bag 50. If desired, the distal ends of the tie segments can be tied or otherwise secured together to prevent them from retracting into the woven material of the bag panels.

Figure 1:
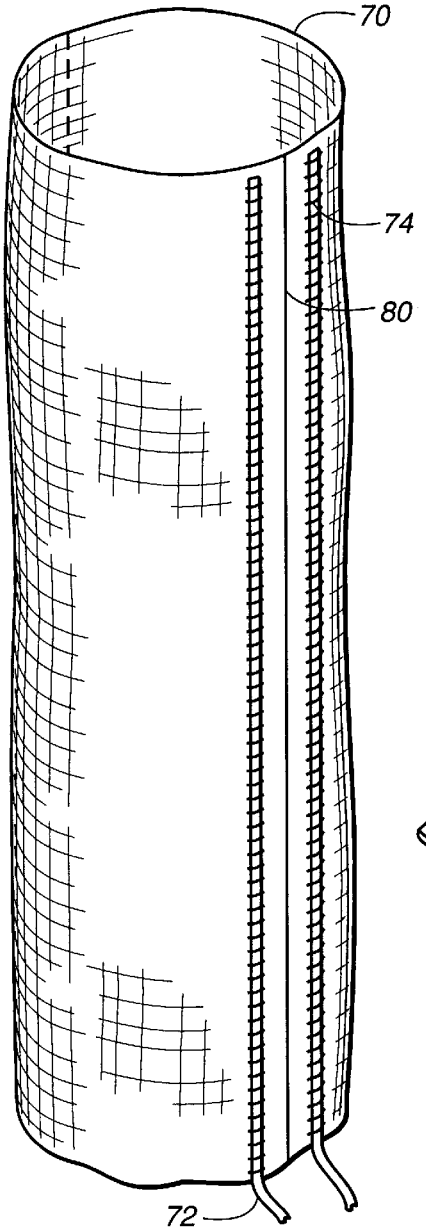
FIG. 1 is a perspective view of a portion of an elongated tube formed by tubular weaving a sheet of flexible material and incorporating spaced first and second tie members woven into the strands of the elongated tube and extending along the length of the tube.

FIG. 1 illustrates in somewhat schematic fashion the initial step or stage in the method of manufacture of bag 40. As with the prior art bag described initially above, the principal component of the bag 40 is formed on a tubular weaving machine such as that identified above with respect to manufacture of the prior art bag. A profound difference exists, however, in that the elongated tube 70 of woven plastic strands shown in FIG. 1 has incorporated therein during the weaving process first and second tie members 72, 74 which are spaced from one another and extend along the length of the tube 70 in the direction of the primary axis of the tube. The cords or tie members are introduced into the tube as warps which are woven with the weft polyurethane strands of the tubular sheet.

The tube 70 is separated on one side thereof by a longitudinal opening 80 which extends along the length of the tube. This opening can be formed by the tubular weaving equipment itself or may be formed later by cutting or severing the tube. In any event, the opening 80 is located at a midpoint between tie members 70 and 74 and is parallel thereto.

Figure 2:
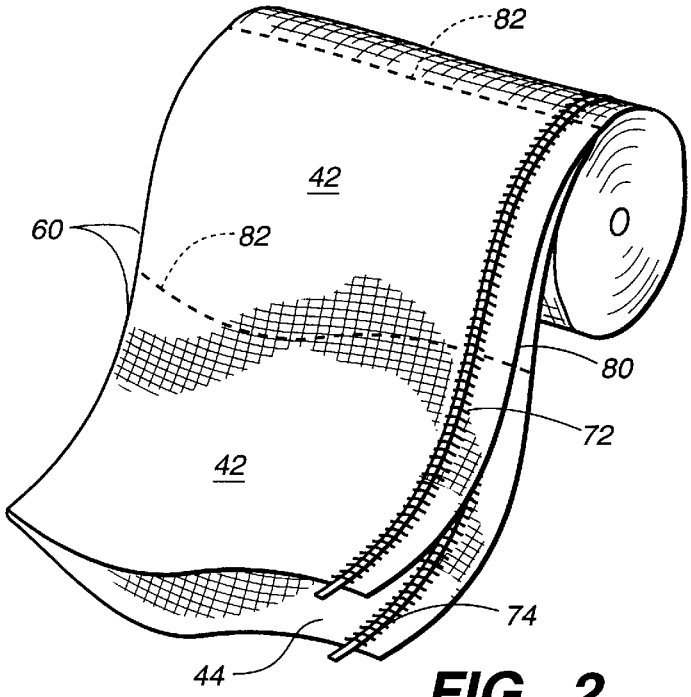
FIG. 2 shows an intermediate step in the manufacture of a double-ended bag from the elongated tube after an elongated opening has been formed in the tube, the sheet material of the tube having been folded and wound into a roll.

The tube 70 is then collapsed as shown in FIG. 2 by bringing the free tube edges defining opening 80 into registration. Similarly, the tie members 72, 74 are brought into registration.

The next step of the operation is to sever the collapsed tube and tie members 72, 74 along lines of cut 82. Such severing or cutting results in tube segments, each of which forms the bag configuration shown in FIG. 3 and prior to sewing of the bag panel edges and one end each of the tie segments as previously described.

It will be appreciated that the tie segments 66, 68 are no longer than the distance between the lines of cut 82. For this reason, it will be necessary for the person forming the bag to retrieve and pull on the distal ends of the tie segments to draw them from the rest of the woven structure. This will result in a very slight cinching or puckering of the bag at its open end. To prevent inadvertent retraction of the tie segment distal ends back into the woven structure, the distal ends may be tied or otherwise secured together.

Figure 8:
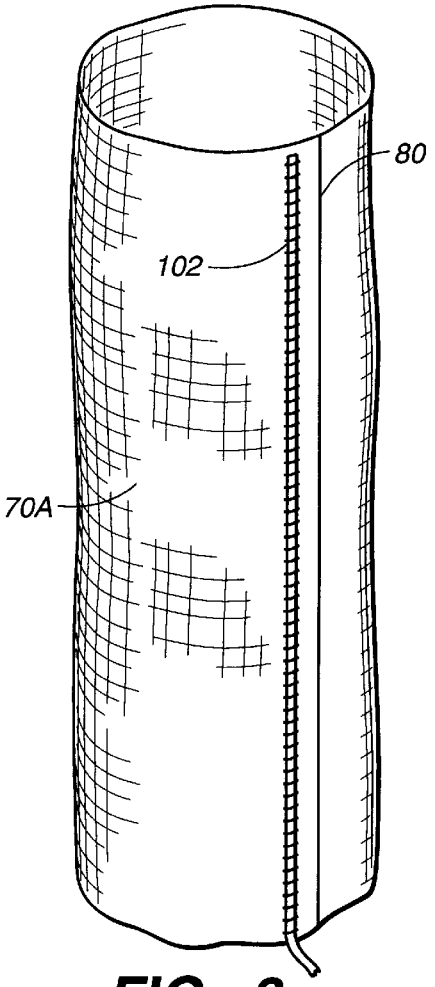
FIG. 8 is a view similar to FIG. 1 but illustrating an elongated tubular woven tube incorporating a single tie member woven into the strands thereof.

Referring now to FIGS. 8–10 and 13–15, another embodiment of the invention is illustrated. In FIG. 8 an elongated tube 70A of woven plastic strands is shown. In this instance, a single tie member 102 is incorporated into the woven plastic strands during the weaving process and extends along the length of the tube 70A in the direction of the primary axis of the tube.

The tube 70A is separated by a longitudinal opening 80 which extends along the length of the tube, the opening being formed by the tubular weaving equipment itself or formed latter by cutting or severing the tube. The opening is adjacent to the tie member 102.

Figure 9:
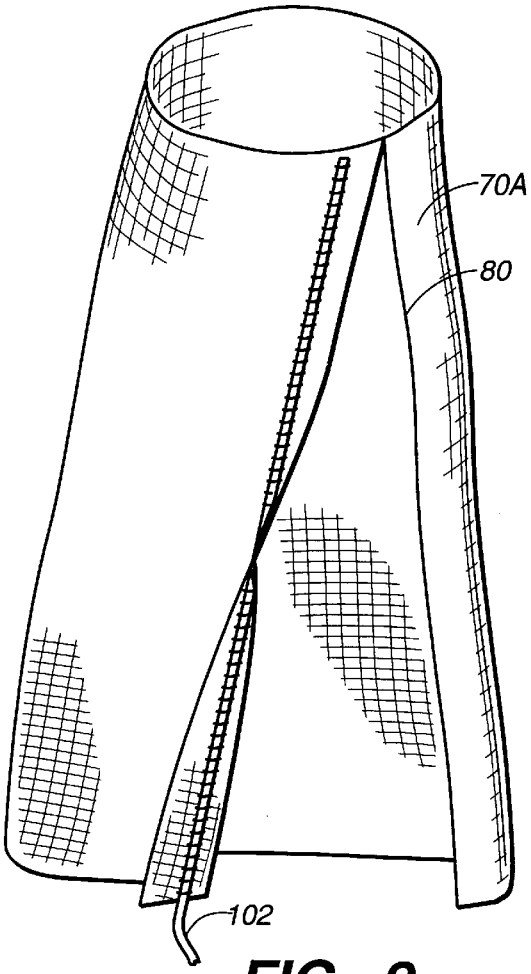
FIG. 9 is a perspective view of the tube of FIG. 8 cut and opened adjacent and parallel to the single tie member.
Figure 10:
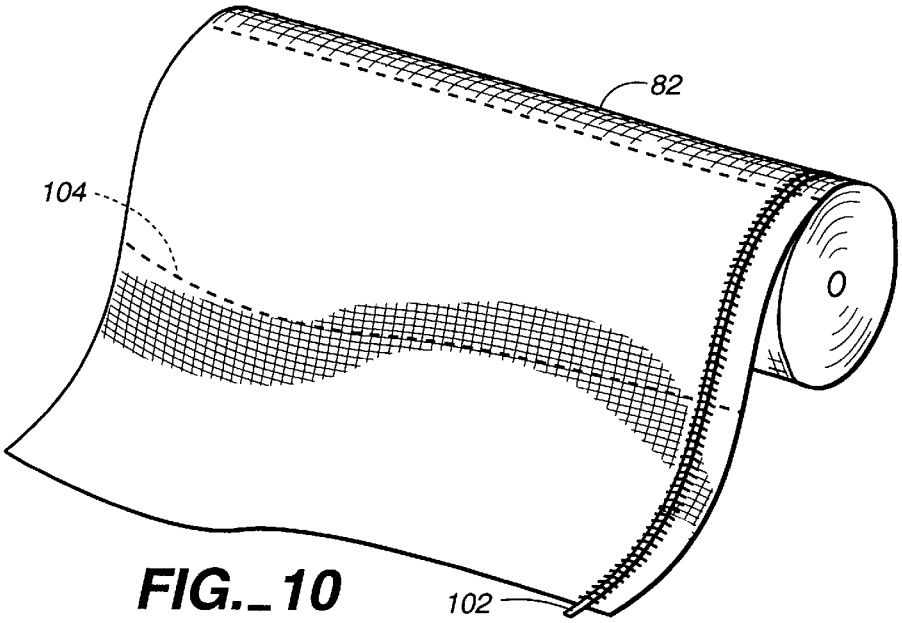
FIG. 10 is a perspective view illustrating the woven material from the tube of FIG. 8 and 9 wound into a roll and incorporating a single tie member.

The tube 70A is opened as shown in FIG. 9 to form a flat sheet of tube material which is rolled into a roll as shown in FIG. 10 with tie member 102 disposed adjacent to one end thereof.

When bags are to be formed, the tube material is severed along lines of cut 82 transverse to the primary axis of the tube material, one such line of cut being illustrated in FIG. 10. As can be seen with reference to that figure, an imaginary fold line 104 is located midway between line of cut 82 and the terminal end of the tube material.

Figure 13:
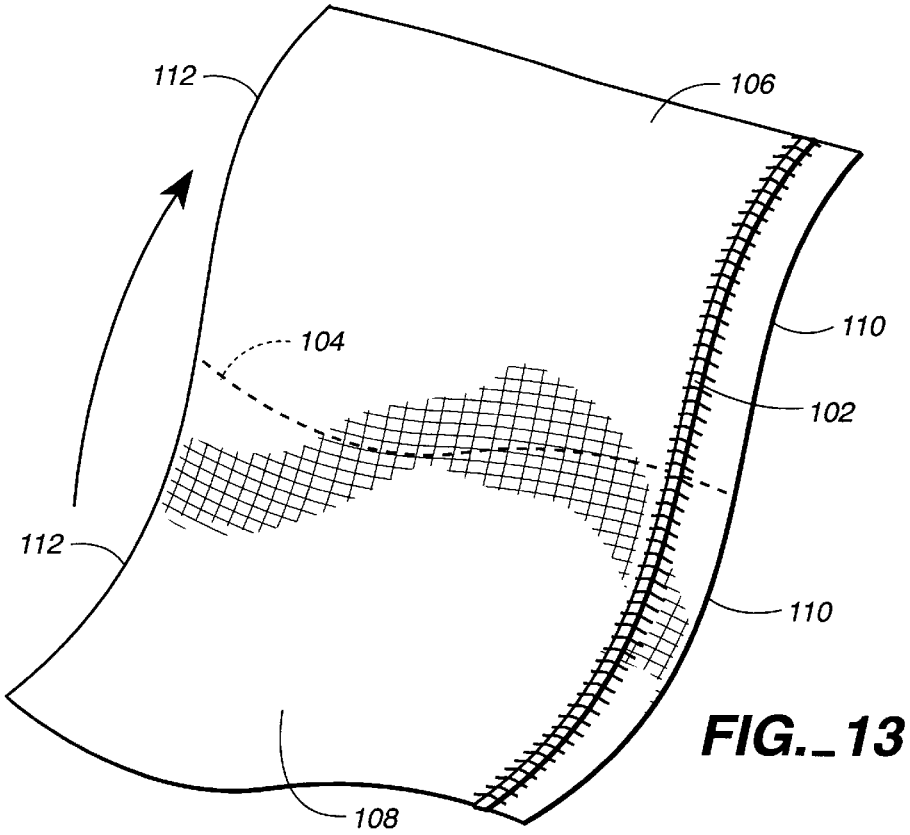
FIGS. 13–15 are perspective views illustrating sequential steps carried out when forming an alternative form of bag from woven sheet material having a single tie member woven therein.

Next, the tube material segment is folded along fold line 104 as shown in FIG. 13.

The tube material segment comprises two bag panels 106, 108 with each bag panel having a panel top end 110, a panel bottom end 112 and two spaced side edges extending between the panel top end and the panel bottom end. One of the side edges is defined by fold line 104 and the other panel side edge located at the free ends 116, 118 of the tube material segment which are brought into registry.

When such folding step is carried out, the tie member 102 is configured into two tie segments 120, 122 which are integral, the free ends of the tie segments being located at the side of the tube material segment defined by free ends 116, 118.

Figure 14:
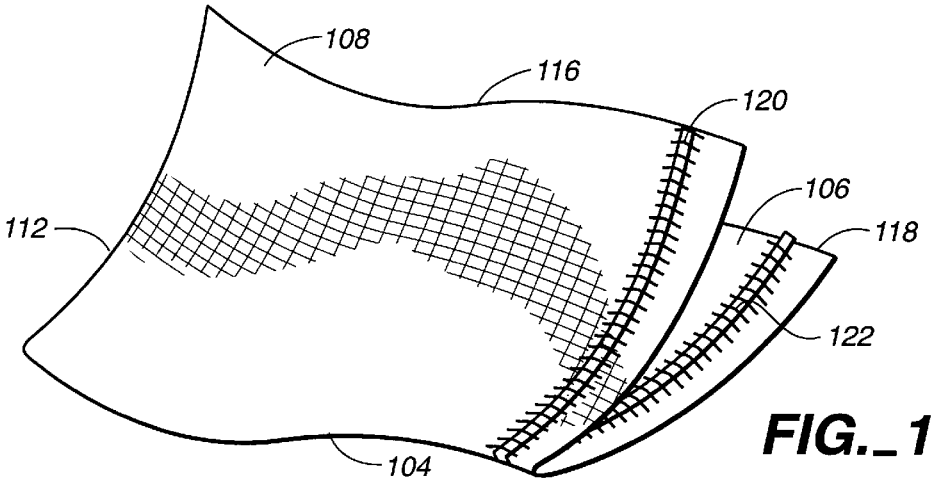
Figure 15:
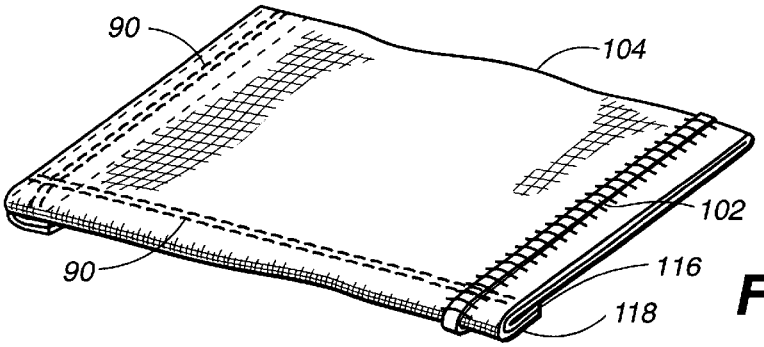

Referring now to FIG. 15, the bottom ends 112 and the side ends 116, 118 are doubled over and sewn along lines of stitching 90. FIG. 15 shows the bag inverted from the position shown in FIG. 14. The formerly free ends of the tie segments located at side edges 116, 118 are sewn together where the side edges are folded over and sewn so that the tie segments form a continuous loop. Thus, an individual can cinch the opening of the bag shut merely by manually grasping the tie member at the side edge of the bag defined by fold line 104. This avoids the necessity of knotting the ends of the tie segments.

Figure 12:
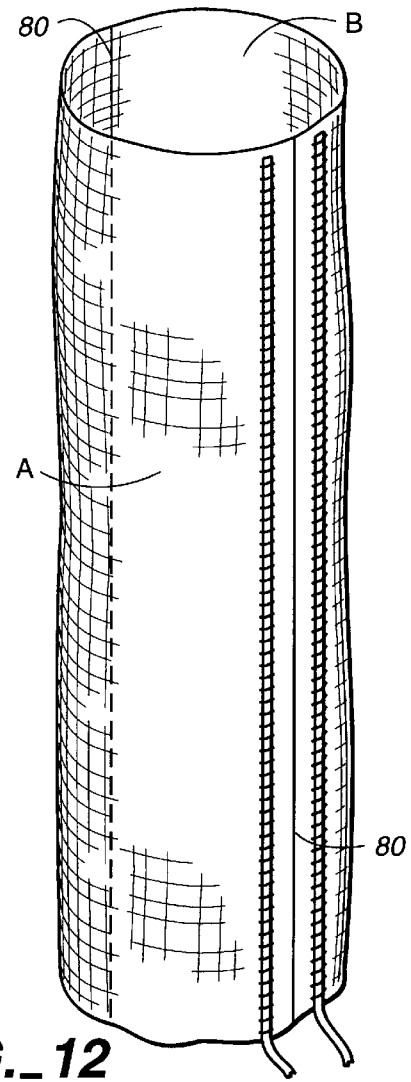
FIG. 12 illustrates an elongated tube having two spaced tie members just prior to conversion thereof into the rolls of FIG. 11.
Figure 11:
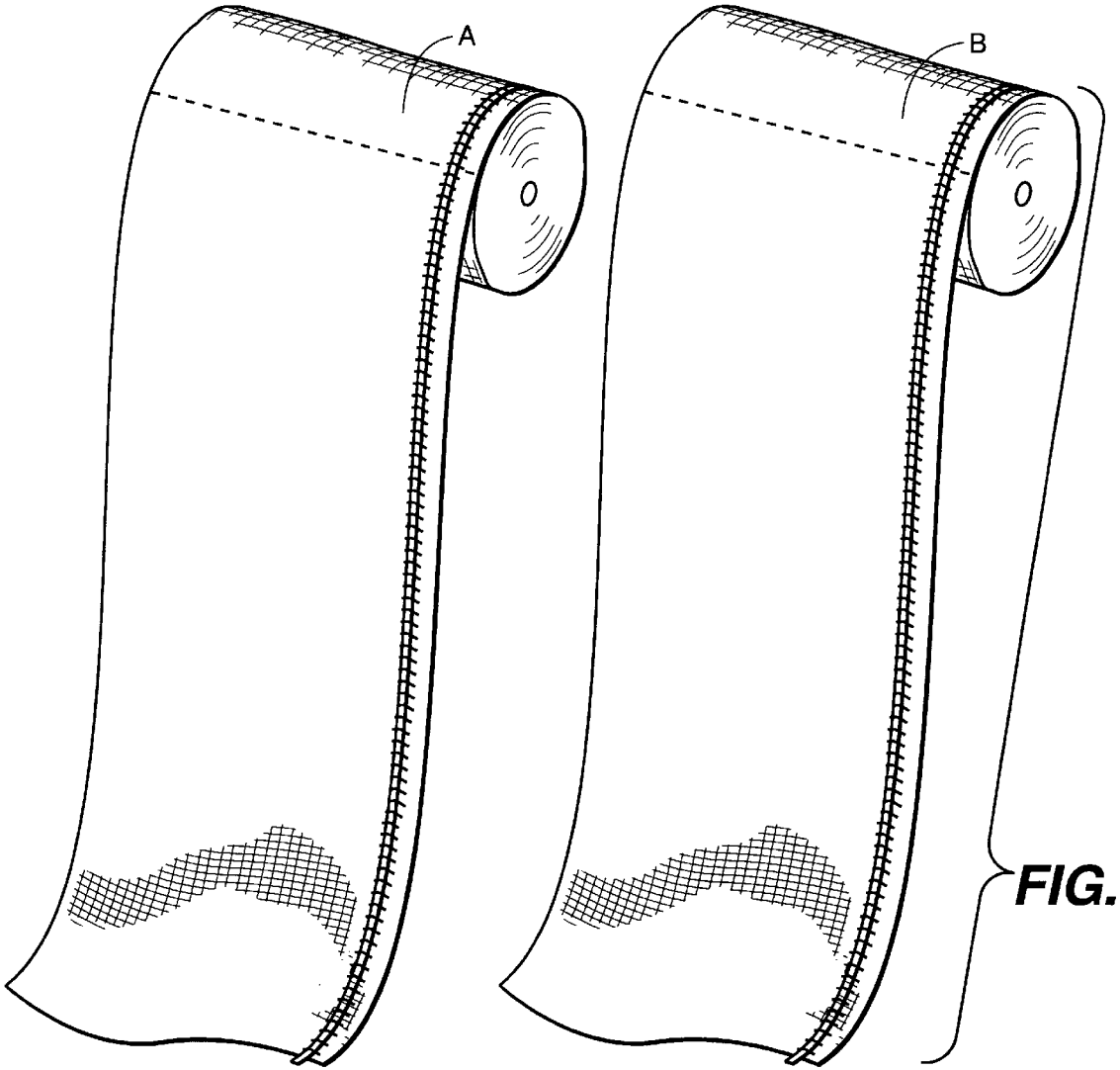
FIG. 11 is a perspective view of two partially unrolled rolls of tubular woven sheet material, each incorporating a single tie member.

FIGS. 11 and 12 illustrate an alternative approach to forming flat sheets of tube material incorporating single tie members subsequently converted into bags.

Referring first to FIG. 12, two cuts 80 are formed in a tube of the type shown in FIG. 1 employing two tie members. This results in the formation of two separate sheets of tube material designated by reference letters A and B shown in FIG. 11. Each of these sheets incorporates a single tie member and may be converted into bags as shown in FIGS. 13–15.

I claim:

1. A method of manufacturing a double-ended bag having first and second bag panels defining a bag interior and a bag opening at one end communicating with said bag interior, said bag additionally including first and second elongated flexible tie members located adjacent to said bag opening for selectively closing said bag opening, said method comprising the steps of:

tubular weaving a sheet of flexible material to form an elongated tube comprised of woven warp and weft strands, said tube having a primary longitudinal axis;

during said tubular weaving step, weaving into said strands said first and second tie members, said first and second tie members being spaced from one another and extending along a length of said tube in a direction parallel to said primary longitudinal axis;

forming an elongated opening in said tube extending along the length of said tube in the direction parallel to said primary longitudinal axis and located between said first and second tie members;

severing said tube and said first and second tie members along spaced lines of cut transverse to said primary longitudinal axis to divide said tube into separate tube segments and said first and second tie members into double-ended first and second tie segments, each tube segment comprising two bag panels, with each bag panel having a panel top end, a panel bottom end and two spaced panel side edges extending between the panel top end and the panel bottom end, and each panel having a tie segment connected thereto and woven therein;

bringing the two bag panels together into substantial registration with the panel bottom ends forming a fold;

substantially simultaneously with the step of bringing the two bag panels together, bringing the tie segments connected thereto into substantial registry; and sewing the bag panels together along the panel side edges thereof, with the two panel top ends being unsecured and forming said bag opening so as to form said bag additionally including first and second elongated flexible tie members located adjacent to said bag opening for selectively closing said bag opening.

2. The method according to claim 1 additionally comprising the step of securing together the first and second tie segments to form a unitary tie extending along the sewn bag panels adjacent to said bag opening.

3. The method according to claim 2 wherein the first and second tie segments are secured together at one end thereof.

4. The method according to claim 3 wherein the first and second tie segments are sewn together at panel side edges.

5. The method according to claim 4 including the step of pulling an end of each of said first and second tie segments away from said panels to provide tie distal ends spaced outwardly from said bag panels.

6. The method according to claim 4 wherein the steps of sewing together said first and second tie segments and sewing together said side panels are carried out substantially simultaneously.

7. The method according to claim 1 wherein said elongated opening is formed in said tube substantially equidistant from said first and second tie segments.

8. The method according to claim 1 including the additional step of folding over said panel side edges to form bights therein prior to the step of sewing the bag panels together along the panel side edges.

* * * * *